US005927883A

United States Patent [19]

Lebauer

[11] Patent Number: 5,927,883

[45] Date of Patent: Jul. 27, 1999

[54] WRITING INSTRUMENT

[76] Inventor: Ian F. Lebauer, R.R. 2 133A Hildreth Rd., Harpswell, Me. 04074

[21] Appl. No.: 09/031,946

[22] Filed: Feb. 27, 1998

[51] Int. Cl.[6] ..... B43K 5/16

[52] U.S. Cl. ..... 401/116; 401/99; 401/55

[58] Field of Search ..... 401/116, 99, 55, 401/68, 75

[56] References Cited

U.S. PATENT DOCUMENTS

| | | | |
|---|---|---|---|
| 1,509,255 | 9/1924 | Pollak | 401/75 |
| 1,558,889 | 10/1925 | Kaiser | 401/75 |
| 2,882,859 | 4/1959 | Poritz | 401/116 |
| 4,844,640 | 7/1989 | Ganz | 401/116 |
| 5,090,831 | 2/1992 | Kageyama et al. | 401/75 |

FOREIGN PATENT DOCUMENTS

| | | | |
|---|---|---|---|
| 788257 | 12/1957 | United Kingdom | 401/116 |

*Primary Examiner*—David J. Walczak
*Attorney, Agent, or Firm*—Daniel S. Ortiz

[57] ABSTRACT

A retractable writing instrument having a marking end which can be extended a variable distance from the end of the writing instrument.

8 Claims, 1 Drawing Sheet

5
4
6
1
3
10
2
12

5
6
4
1
9
3
10
2
12

7
8
6
16
3
15
14
17
2
20
13

5
4
19
9
10
18
12

11
4
19

WRITING INSTRUMENT

STATEMENT REGARDING FEDERALLY SPONSORED RESEARCH OR DEVELOPMENT

Not applicable.

FIELD OF THE INVENTION

The invention is a writing instrument having a retractable marking end.

BACKGROUND OF THE INVENTION

There are many mechanical writing instruments having retractable marking ends currently in commercial production. However, the writing instruments are designed to provide a writing member having a writing end with a fixed relation with the end of the holding portion of the writing instrument. However, the fixed relationship between the marking end of the writing member and the end of the holding member is inconvenient in some circumstances such as drawing a line along the edge of a ruler or for persons who use the writing instrument with a particular slant in their holding thereof. It would therefore be useful to provide a writing instrument with a retractable writing member having a marking end which could be positioned at different relationships between the end of the holding member and the marking end of the writing member.

SUMMARY OF THE INVENTION

According to the present invention, a writing instrument is provided which comprises a holding member having a front end and a back end; a writing member slidingly arranged in the holding member and biased toward the back end of the holding member; an opening in the front end of the holding member to permit a marking end of the writing member to protrude from the holding member; a threaded rod rotatably engaged with a threaded opening, arranged at the back end of the holding member, with a first end of the rod extending into the holding member and a second end of the rod extending out of the back end of the holding member so that the rod is moved axially along the holding member when the rod is rotated; a means for rotating the rod arranged at the second end of the rod wherein axial movement of the first end of the rod toward the front end of the holding member causes the marking end of the writing member to protrude from the front end of the holding member.

DETAILED DESCRIPTION OF THE INVENTION

Figures 1, 2, 3, 4, 5:
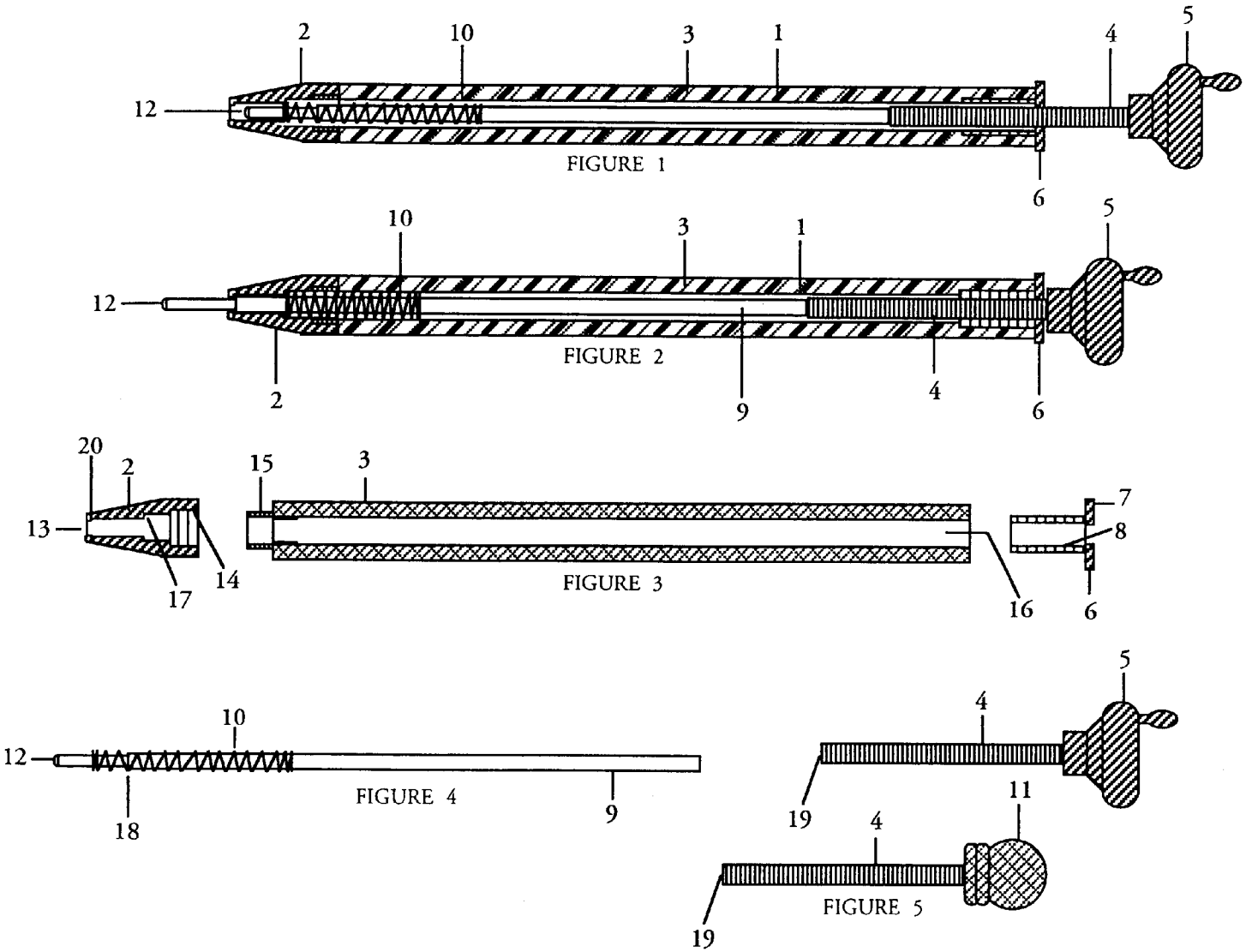
FIG. 1 is a cross-section of an embodiment of the writing instrument with the marking end of the writing member retracted into the writing instrument.
FIG. 2 is a cross-section of the writing instrument of FIG. 1 with the marking end of the writing member protruding from the holding member.
FIG. 3 is an exploded view in cross-section of the writing instrument without the writing member.
FIG. 4 is a cross-sectional view of the writing member and a biasing means.
FIG. 5 is a second embodiment of the rotatable rod with the rotating means arranged at the second end of the rod.

FIG. 1 shows the writing instrument of the invention with the marking end of the writing member retracted into the writing instrument. The writing instrument shown in FIG. 1 comprises a holding member 1 which comprises a tip 2 having a hole 13 through which the marking end 12 of the writing member 9 protrudes. The writing member 9 is slideably arranged in a holding body member 3. The writing member 9 is biased toward the back end of the holding body member 3 by a biasing member 10 which, as shown in FIG. 1, is a coil spring 10. As shown in FIG. 4, one end of the coil spring 10 is engaged with the writing member 9 about its mid-point and the second end of the coil spring 10 extends to a point below a shoulder 18 on writing member 9. The biasing member, coil spring 10, rests against a ledge 17 in the tip member 2. The tip member 2 engages the holding body member 3 by thread means 14 which engage thread means 15 on holding body member 3. The tip means 2 has a hole 13 through which the marking end 12 of the writing member 9 protrudes. The shoulder 18 on writing member 9 butts against ledge 20 in tip 2 when the marking end 12 of writing member 9 is extended fully from the writing instrument. The hole 13 can conform closely to the circumference of writing member 9 to provide lateral support for marking end 12.

The coil spring 10 biases the writing member 9 toward the back end of the holding body member 3. A threaded rod member 4 engages the threads in the threaded opening in boss member 6 which is inserted into the back end of holding body member 3. The flange 7 of boss 6 having the internally threaded hole 8 butts against the end of the holding body member 3. The boss 6 can be press fitted into the holding body member 3. In the alternative, the boss 6 may have protrusions or other means which grip the sides of holding body member 3 to prevent the boss 6 from being forced from the holding member 3 when pressure is applied to the writing member 9 by rotation of the rod for axial movement along the holding member 3. The rotatable rod 4 has arranged at its second end rotation means 5 which is shown in FIGS. 1, 2 and 3 as a disc with a small handle. Other rotating means such as the ball 11 shown in FIG. 5 can also be utilized. Type of rotating means attached to rotatable threaded rod 4 is a matter of choice and fanciful means such as a cube, animal representations, rectangular sections, crosses, athletic equipment and the like can be attached to the threaded rod 4 to provide for ease of rotation. The rotating means can comprise a representation of a ball such as a baseball, golf ball, football, soccer ball, basketball, tennis ball and the like.

A separate boss member 6 is shown, however the threaded hole can be formed directly in holding body member 3. Holding body member 3 can be formed from wood, plastic and resins, metal and the like, depending on the tactile impression desired. The holding body member can also be covered by a soft covering member, not shown, if a soft tactile impression is required.

Writing member 9 can be a ballpoint or roller ball writing cartridge.

FIG. 2 illustrates the writing instrument of the invention with the marking end 12 of writing member 9 extending out of the tip 2. The maximum extension of the marking end 12 from the tip 2 occurs when the shoulder 18 of writing member 9 butts against the shoulder 20 in the tip 2.

The marking end 12 of writing member 9 can be extended a distance between the end of opening 13 in tip 2 to the point where the shoulder 18 of writing member 9 abuts against shoulder 20 of tip 2.

Tip 2 can be engaged with holding body member 3 by threads 14 on the internal portion of tip 2 and threads 15 on the external surface of holding body member 3. Threads 15 can be formed directly on holding body member 3 or be formed on a boss member inserted into holding body member 3 as shown in FIG. 3. Writing member 9 is slidably arranged in a cylindrical hole 16 in holding body member 3.

In operation, threaded rod 4 is rotated by rotating means 5 or 11 to advance the end 19 of threaded rod 4 which is engaged with the internal threads of boss 6 into axial hole 16 in holding body member 3. End 19 of threaded rod 4 bears against the end of writing member 9 and causes writing member 9 to push against biasing spring 18 to cause marking end 12 of writing member 9 to protrude through hole 13 in tip 2.

The distance that marking end 12 of writing member 9 protrudes from tip 2 is determined by the distance the end 19 of threaded rod 4 is advanced into the hole 16 in holding body member 3.

The distance marking end 12 protrudes from tip 2 is determined by the relationship of the marking end 12 and the shoulder 18 of writing member 9. The maximum protrusion of marking end 12 from tip 2 occurs when the shoulder 18 of writing member 9 abuts against shoulder 20 of tip 2.

The writing instrument is particularly useful in that the distance that the marking end 12 can protrude from tip 2 is variable and can be adjusted to conform to the writing habits of the user or to provide for movement along the edge of a ruler or the like.

I claim:

1. A writing instrument comprising:

a holding member having a front end and a back end;

a writing member slidably arranged in the holding member and biased toward the back end of the holding member;

an opening in the front end of the holding member to permit a marking end of the writing member to protrude from the holding member;

a threaded rod rotatably engaged with a threaded opening, arranged at the back end of the holding member, with a first end of the rod extending into the holding member and a second end of the rod extending out of the back end of the holding member, so that the rod is moved axially along the holding member when the rod is rotated; and a member for rotating the rod arranged at the second end of the rod wherein axial movement of the first end of the rod toward the front end of the holding member causes the marking end of the writing member to protrude from the front end of the holding member.

2. The writing instrument of claim 1 wherein a biasing means for biasing the writing member toward the back end of the holding member comprises a coil spring.

3. The writing member of claim 1 wherein the rotating means for rotating the threaded rod comprises a circular disk.

4. The writing instrument of claim 1 wherein the means for rotating the rod comprises a ball member.

5. The writing instrument of claim 1 wherein the front end comprises a tip having a shoulder means for engaging a shoulder means on the writing member.

6. The writing instrument of claim 5 wherein the tip has a second shoulder means for engaging a biasing spring means.

7. The writing instrument of claim 1 wherein the front end comprises a tip having a shoulder means for engaging a biasing spring means.

8. The writing instrument of claim 1 wherein the holding member comprises a body holding member and a tip engaged with a boss means at a front end of the body holding member.

* * * * *